US005606152A

United States Patent [19]

Higashiura et al.

[11] Patent Number: 5,606,152

[45] Date of Patent: Feb. 25, 1997

[54] MULTILAYER INSULATED WIRE AND A MANUFACTURING METHOD THEREFOR

[75] Inventors: Atsushi Higashiura; Toshiki Maezono, both of Hiratsuka; Nobuyuki Nakamura, Fujisawa; Shigeo Yamaguchi, Hiratsuka; Mitsuru Inoue, Hiratsuka; Isamu Kobayashi, Hiratsuka; Fumikazu Sano, Hiratsuka, all of Japan

[73] Assignee: The Furukawa Electric Co., Ltd., Tokyo, Japan

[21] Appl. No.: 142,500

[22] Filed: Oct. 22, 1993

[30] Foreign Application Priority Data

Oct. 28, 1992 [JP] Japan ..... 4-290160

[51] Int. Cl.[6] ..... H01B 3/00; H01B 7/02

[52] U.S. Cl. ..... 174/120 R; 174/120 SR

[58] Field of Search ..... 174/120 R, 120 SR, 174/110 SR, 110 N, 110 PM

[56] References Cited

U.S. PATENT DOCUMENTS

| | | | |
|---|---|---|---|
| 4,346,136 | 8/1982 | Lupinski | 174/110 SR |
| 4,390,590 | 6/1983 | Saunders et al. | 174/120 SR |
| 4,410,592 | 10/1983 | Saunders et al. | 174/120 SR |
| 4,420,535 | 12/1983 | Walrath et al. | 174/120 SR |
| 4,420,536 | 12/1983 | Saunders et al. | 174/110 N |
| 4,801,501 | 1/1989 | Harlow | 174/120 SR |
| 5,293,146 | 3/1994 | Aosaki et al. | 174/120 SR |
| 5,310,128 | 6/1994 | Dupont et al. | 560/78 |
| 5,396,104 | 3/1995 | Kimura | 257/784 |

FOREIGN PATENT DOCUMENTS

| | | |
|---|---|---|
| 0012014 | 6/1980 | European Pat. Off. . |
| 0258036 | 3/1988 | European Pat. Off. . |
| 0373669 | 6/1990 | European Pat. Off. . |
| 57-5214 | 1/1982 | Japan . |

(List continued on next page.)

OTHER PUBLICATIONS

International Standard, CEI, IEC 601-1, 2nd Ed., (1988), "Medical Electrical Equipment", pp. 1-351.

International Standard, CEI, IEC 601-1, Amendment 1, (1991), "Medical Electrical Equipment", pp. 1-50.

(List continued on next page.)

*Primary Examiner*—Kristine L. Kincaid
*Assistant Examiner*—Chau N. Nguyen
*Attorney, Agent, or Firm*—Frishauf, Holtz, Goodman, Langer & Chick, P.C.

[57] ABSTRACT

Provided is a multilayer insulated wire comprising a conductor and three or more insulating layers covering the conductor, in which each of first and second insulating layers, as counted from the conductor side, is (a) an extrusion-coating layer of an intimate resin mixture compounded so that an ethylene-based copolymer, having a carboxylic acid or a metal salt of the carboxylic acid on the side chain thereof, accounts for 5 to 40 parts by weight compared to 100 parts by weight of a thermoplastic straight-chain polyester resin, (b) an extrusion-coating layer consisting mainly of a thermoplastic straight-chain polyester resin formed by combining an acid constituent and an alcoholic constituent the whole or a part of which is cyclohexanedimethanol, or (c) an extrusion-coating layer of an intimate resin mixture compounded so that the ethylene-based copolymer, having the carboxylic acid or the metal salt of the carboxylic acid on the side chain thereof, accounts for 50 parts or less by weight compared to 100 parts by weight of the thermoplastic straight-chain polyester resin formed by combining the acid constituent and the alcoholic constituent the whole or a part of which is cyclohexanedimethanol, a third insulating layer being an extrusion-coating layer of a thermoplastic polyamide resin or a intimate resin mixture consisting mainly of the thermoplastic polyamide resin. Also provided is a bondable multilayer insulated wire which further comprises a bondable layer of an copolymerized-polyamide resin formed on the third insulating layer.

19 Claims, 1 Drawing Sheet

FOREIGN PATENT DOCUMENTS

| | | |
|---|---|---|
| 62-293705 | 12/1987 | Japan . |
| 64-765 | 1/1989 | Japan . |
| 1-29283 | 6/1989 | Japan . |
| 3-20421 | 2/1991 | Japan . |
| 3-56112 | 5/1991 | Japan . |
| 3-110721 | 11/1991 | Japan . |
| 3-106626 | 11/1991 | Japan . |

OTHER PUBLICATIONS

IEC 950 prepared by Technical Committee No. 74, (1991), "Safety of Information Technology Equipment, Including Electrical Business Equipment", pp. 3–353.

CEI, IEC Publication No. 65, (1976), "Safety Requirements for Mains Operated Electronic and Related Apparatus for Household and Similar General Use", pp. 3–133.

International Standard, CEI, IEC 65, (1989), Amendment 2, "Safety Requirements for Mains Operated Electronic and Related Apparatus for Household and Similar General Use", pp. 1–47.

International Standard, CEI, IEC 65, (1992), Amendment 3, "Safety Requirements for Mains Operated Electronic and Related Apparatus for Household and Similar General Use", pp. 1–20.

International Standard, CEI, IEC 335–1, 3d Ed., (1991), "Safety of Household and Similar Electrical Applicances", pp. 1–239.

IEC (International Electrotechnical Communication) Standards Publication 950, p. 13.

IEC (International Electrotechnical Communication) Standards Publication 65 (1985).

*Catalogue '91,* IEC (International Electrotechnical Communication) Standards Publication 335, p. 61.

*Catalogue '91,* IEC (International Electrotechnical Communication) Standards Publication 601, pp. 97–98.

MULTILAYER INSULATED WIRE AND A MANUFACTURING METHOD THEREFOR

BACKGROUND OF THE INVENTION

1. Field of the Invention

The present invention relates to a multilayer insulated wire having three or more insulating layers and a manufacturing method therefor, and more particularly, to a multilayer insulated wire, which enjoys a high coilability and is adapted for use as a winding or lead wire of a transformer incorporated in electrical or electronic equipment, and in which separability between insulating layers is so good that the insulating layers can be removed, and solder is allowed to adhere to a conductor in a short period of time when they are dipped in a solder bath, so that the solderability is high, further the insulation properties of the insulating layers cannot be easily lowered with time, and a manufacturing method for the multilayer insulated wire.

2. Prior Art

The construction of a transformer is prescribed by IEC (International Electrotechnical Commission) standards Pub. 950, 65, 335, 601, etc. These standards provide that an enamel film which covers a conductor of a winding be not authorized as an insulating layer, and that at least three insulating layers be formed between primary and secondary windings or the thickness of an insulating layer be 0.4 mm or more. The standards also provide that the creeping distance between the primary and secondary windings, which varies depending on the applied voltage, be 5 mm or more, that the transformer withstand a voltage of 3,000 V applied between the primary and secondary sides for a minute or more, and the like.

Accordingly, a currently prevailing transformer has a profile such as the one illustrated in FIG. 1. Referring to FIG. 1, a flanged bobbin 2 is fitted on a ferrite core 1, and an enameled primary winding 4 is wound around the bobbin 2 in a manner such that insulating barriers 3 for securing the creeping distance are arranged individually on the opposite sides of the peripheral surface of the bobbin. An insulating tape 5 is wound for at least three turns on the primary winding 4, additional insulating barriers 3 for securing the creeping distance are arranged on the insulating tape, and an enameled secondary winding 6 is then wound around the insulating tape.

Recently, a transformer which includes neither the insulating barriers 3 nor the insulating tape 5, as shown in FIG. 2, has started to be used in place of the transformer having the profile shown in FIG. 1.

The transformer shown in FIG. 2 has an advantage over the one shown in FIG. 1 in being able to be reduced in overall size and dispense with the winding operation for the insulating tape.

In manufacturing the transformer shown in FIG. 2, it is necessary, in consideration of the aforesaid IEC standards, that at least three insulating layers 4*b* (6*b*), 4*c* (6*c*), and 4*d* (6*d*) are formed on one or both of conductors 4*a* and 6*a* of primary and secondary windings 4 and 6 used, and that the individual insulating layers can be separated from one another.

One such known winding is described in Jpn. UM Appln. KOKAI Publication No. 3-106626. In this case, an insulating tape is first wound around a conductor to form a first insulating layer thereon, and is further wound to form second and third insulating layers in succession. Thus, three insulating layers are formed so as to be separable from one another. In another known winding disclosed in Jpn. UM Appln. KOKAI Publication No. 3-56112, a conductor enameled with polyurethane is successively extrusion-coated with fluoroplastics, whereby extrusion-coating layers composed of three layers structure are formed for use as insulating layers.

In the former case, however, winding the insulating tape is an unavoidable operation, so that the efficiency of production is extremely low, thus entailing increased manufacturing cost.

In the latter case, the insulating layers, which are formed of fluoroplastics, enjoy a satisfactory thermal resistance. Since the adhesion between the conductor and the insulating layers and between the insulating layers is poor, however, the resulting insulated wire lacks in reliability.

In coiling the insulated wire, it is guided through a guide nozzle as it is wound around a coil bobbin. During this operation, the insulating layers may be easily separated from the conductor as the insulated wire rubs against the guide nozzle, or the insulating layers may be separated from one another. If the wire in this state is wound around the coil bobbin, the insulating layers are torn by the friction between the adjacent turns of the insulated wire or the like. In this situation, the electrical properties, e.g., dielectric breakdown properties, of the resulting coil are spoiled.

The insulating layers cannot be removed by being dipped into a solder bath. In processing terminals for the connection between the insulated wire and lead pins, for example, therefore, the insulating layers at the terminals must be removed by some low-reliability mechanical means.

In order to solve such problems as aforesaid, an investigation is being made into an arrangement such that a conductor is extrusion-coated with a polyethylene terephthalate (PET) resin, which enjoys high electrical insulation properties and thermal resistance and easily decomposes at the melting temperature of solder, to form an insulating layer.

However, this PET resin cannot fulfill its proper thermal resistance and mechanical properties until it is crystallized under appropriate conditions which make that resin orientate. Therefore, a highly crystallized insulating layer cannot be obtained by extrusion-coating, so that the dielectric strength requires improvement.

In the case of a wire in which all three insulating layers are formed of the PET resin, there is room for improvement in the insulation properties of a coil formed by coiling the wire.

This problem may be attributable to the following circumstances. Since the surface of each PET resin layer, formed as an insulating layer, has a high coefficient of friction, the insulating layers are liable to cracking or damages as they rub against the guide nozzle of a coiling machine during coiling operation. Moreover, the adhesion between the insulating layers, formed the PET resin, is so good that cracks and the like in the outermost layer easily affect the lower insulating layers due to a notch effect.

Also known is an insulated wire, though not multilayer, in which a bondable layer is formed as the outermost layer by coating a resin such as polyamide on the surface of an enameled wire by baking.

As this insulated wire is wound into a coil, its increasing turns are adhered together, so that the coil can be prevented from loosening. Thus, the reliability of the coil as a final product can be improved, and the efficiency of coil production can be increased.

Usually, the bondable layer of the above-described insulated wire is formed by applying a paint, which is composed of a bondable resin dissolved in a solvent, to the surface of an enameled wire and then baking the resulting structure. Accordingly, the wettability of the interface between the bondable layer and an insulating film covering the enameled wire is improved, so that the bondable layer can firmly adhere to the insulating film with ease. Thus, various materials can be utilized for the bondable layer.

If a multilayer insulated wire, like the insulated wire described above, is formed having the bondable layer outside the triple insulating layers, the resulting coil can be prevented from loosening by the high-bonding strength of the bondable layer during the coiling operation, and the reliability of the coiling operation can be improved.

However, no solvent is used for the manufacturing of the bondable multilayer insulated wire in which the individual insulating layers and the bondable layer on the outermost insulating layer are formed by extrusion-coating. Unlike the enameled wire, therefore, this insulated wire cannot enjoy the effect of the solvent to improve the wettability of the interface between the bondable layer and the outermost insulating layer positioned under the bondable layer.

Accordingly, the force of adhesion between the bondable layer and the outermost insulating layer cannot be very great.

When the bondable multilayer insulated wire is coiled, therefore, the outside bondable layer sometimes may be separated from the insulating layer thereunder or scraped off by friction with the guide nozzle. Thus, even if the bondable layer remains on the outermost insulating layer, its adhesiveness is lowered considerably.

In the case of a multilayer insulated wire which complies with the aforementioned IEC standards, interlaminar separation between at least three insulating layers is in the state of being possible. If the bondable layer, the outermost layer, is separated or scraped off and adheres to the inner surface of the guide nozzle, therefore, the following awkward situations are liable to be entailed.

First, a tension which acts on the insulated wire being wound increases, so that snapping of the wire is caused between the guide nozzle and the coil bobbin. Further, the constituent resin of the bondable layer adhering to the inner surface of the guide nozzle rubs against the insulating layers, thereby tearing the insulating layers, and moreover, causing the insulating layers to be separated from one another. If the insulated wire is wound around the coil bobbin in this state, the insulating layers are torn by the friction between the adjacent turns of the wound wire.

If the insulating layers are torn in this manner, the electrical insulation properties, e.g., dielectric breakdown properties, of the coil are ruined.

SUMMARY OF THE INVENTION

An object of the present invention is to provide a multilayer insulated wire, which complies with the IEC standards, enjoying good solderability and high coilability, and in which the electrical insulation properties of insulating layers lower less with time, and a manufacturing method for the wire.

Another object of the present invention is to provide a bondable multilayer insulated wire, which complies with the IEC standards, enjoying good solderability, and can be coiled with high reliability without entailing separation of a bondable layer from the insulating layer, and a manufacturing method for the wire.

In order to achieve the above objects, according to the present invention, there is provided a multilayer insulated wire comprising a conductor and three or more insulating layers covering the conductor, in which each of first and second insulating layers, as counted from the conductor side, is (a) an extrusion-coating layer (hereinafter referred to as extrusion-coating layer a) of an intimate resin mixture compounded so that an ethylene-based copolymer, having a carboxylic acid or a metal salt of the carboxylic acid on the side chain thereof, accounts for 5 to 40 parts by weight compared to 100 parts by weight of a thermoplastic straight-chain polyester resin, (b) an extrusion-coating layer (hereinafter referred to as extrusion-coating layer b) consisting mainly of a thermoplastic straight-chain polyester resin formed by combining an acid constituent and an alcoholic constituent the whole or a part of which is cyclohexanedimethanol, or (c) an extrusion-coating layer (hereinafter referred to as extrusion-coating layer c) of an intimate resin mixture compounded so that the ethylene-based copolymer, having the carboxylic acid or the metal salt of the carboxylic acid on the side chain thereof, accounts for 50 parts or less by weight compared to 100 parts by weight of the thermoplastic straight-chain polyester resin formed by combining the acid constituent and the alcoholic constituent the whole or a part of which is cyclohexanedimethanol, and a third insulating layer is an extrusion-coating layer of a thermoplastic polyamide resin or a intimate resin mixture consisting mainly of the thermoplastic polyamide resin.

According to the present invention, moreover, there is provided a manufacturing method for a multilayer insulated wire, comprising cooling the surface of a first and/or second extrusion-coating layer to 100° C. or below when extrusion-coating of three or more insulating layers is finished, in forming the insulating layers on the surface of a conductor by extrusion-coating.

According to the present invention, furthermore, there is provided a bondable multilayer insulated wire comprising a conductor, three or more insulating layers covering the surface of the conductor, and a bondable layer covering the outermost one of the insulating layers, in which each of first and second insulating layers, as counted from the conductor side, is (a) an extrusion-coating layer (hereinafter referred to as extrusion-coating layer a) of an intimate resin mixture compounded so that an ethylene-based copolymer, having a carboxylic acid or a metal salt of the carboxylic acid on the side chain thereof, accounts for 5 to 40 parts by weight compared to 100 parts by weight of a thermoplastic straight-chain polyester resin, (b) an extrusion-coating layer (hereinafter referred to as extrusion-coating layer b) consisting mainly of a thermoplastic straight-chain polyester resin formed by combining an acid constituent and an alcoholic constituent the whole or a part of which is cyclohexanedimethanol, or (c) an extrusion-coating layer (hereinafter referred to as extrusion-coating layer c) of an intimate resin mixture compounded so that the ethylene-based copolymer, having the carboxylic acid or the metal salt of the carboxylic acid on the side chain thereof, accounts for 50 parts or less by weight compared to 100 parts by weight of the thermoplastic straight-chain polyester resin formed by combining the acid constituent and the alcoholic constituent the whole or a part of which is cyclohexanedimethanol, a third insulating layer is an extrusion-coating layer of a thermoplastic polyamide resin or a intimate resin mixture consisting mainly of the thermoplastic polyamide resin, and the bondable layer is an extrusion-coating layer of an interpolyamide resin.

DETAILED DESCRIPTION OF THE INVENTION

Figure 1:
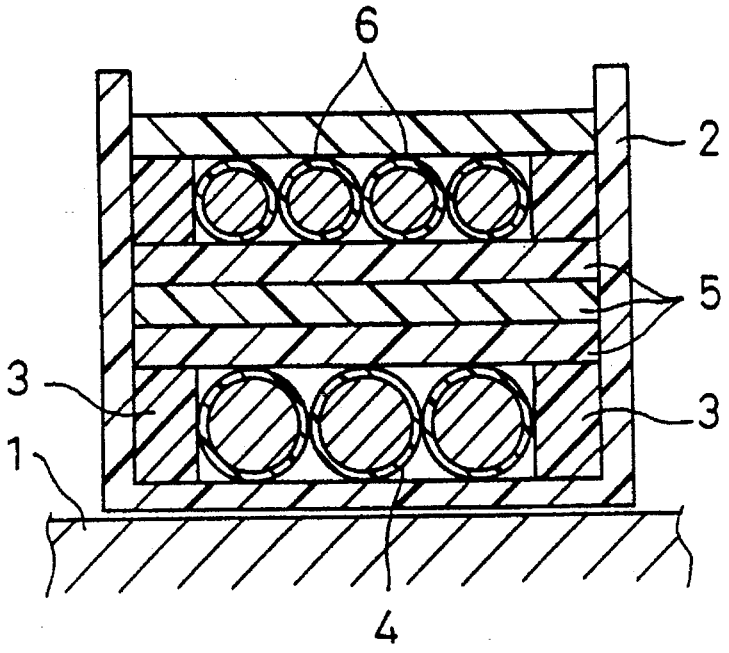
FIG. 1 is a sectional view showing an example of a transformer having a conventional construction.
Figure 2:
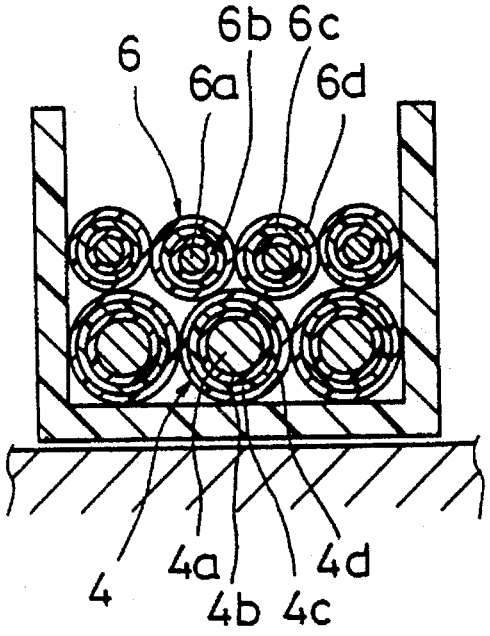
FIG. 2 is a sectional view showing an example of a transformer in which three-layer insulated wires are used as windings.

In a multilayer insulated wire or bondable multilayer insulated wire according to the present invention, first and second insulating layers, as counted from the conductor side, may be formed of layers. of only one type selected from extrusion-coating layers a, b and c or of different types individually.

In this case, the wire whose first and second insulating layers are formed of the extrusion-coating layer a each is an insulated wire which enjoys a particularly high solderability.

On the other hand, the wire whose first and second insulating layers are formed of the extrusion-coating layer b or c each is an insulated wire which enjoys a particularly high thermal resistance.

In each of the wires described above, resins or intimate resin mixtures used to form the first and second insulating layers may be different in compositions.

In the case of forming the first and second insulating layers such that one layer is formed by the layer a and another layer is formed by layer b or c, then the resulting multilayer insulated wire is well-balanced in solderability and thermal resistance.

The intimate resin mixture which constitutes the extrusion-coating layer a contains a thermoplastic straight-chain polyester resin and an ethylene-based copolymer as essential ingredients.

Available examples of the thermoplastic straight-chain polyester resin are materials which are obtained by an esterification reaction between aliphatic diol and an aromatic dicarboxylic acid or a dicarboxylic acid obtained by replacing part of the aromatic dicarboxylic acid with an aliphatic dicarboxylic acid. Typical examples include polyethylene terephthalate (PET) resin, polybutylene terephthalate (PBT) resin, polyethylene naphthalate resin, etc.

Available aromatic dicarboxylic acids for the synthesis of the thermoplastic straight-chain polyester resin include, for example, terephthalic acid, isophthalic acid, terephthal dicarboxylic acid, diphenylsulfone dicarboxylic acid, diphenoxyethane dicarboxylic acid, diphenylether dicarboxylic acid, methyl terephthalic acid, methyl isophthalic acid, etc. Among these acids, terephthalic acid is particularly appropriate.

Available aliphatic dicarboxylic acids for the partial replacement of the aromatic dicarboxylic acid include, for example, succinic acid, adipic acid, sebacic acid, etc. Preferably, the displacement of these aliphatic dicarboxylic acids is less than 30 mol % of the aromatic dicarboxylic acid, and more preferably less than 20 mol %.

Available aliphatic diols for the esterification reaction include, for example, ethylene glycol, trimethylene glycol, tetramethylene glycol, hexane diol, decane diol, etc. Among these materials, ethylene glycol and tetramethylene glycol are appropriate. The aliphatic diols may partially contain oxy glycols, such as polyethylene glycol, polytetramethylene glycol.

Other essential ingredients of the intimate resin mixture which constitutes the extrusion-coating layer a may, for example, be an ethylene-based copolymer having a carboxylic acid or its metal salt on the side chains of polyethylene.

This ethylene-based copolymer serves to restrain the thermoplastic straight-chain polyester resin from crystallizing, thereby inhibiting deterioration of the electrical properties of the formed insulating layers with time, and contributing to the security of good separability between the first and second insulating layers.

Available carboxylic acids to be bonded include, for example, unsaturated monocarboxylic acids, such as acrylic acid, methacrylic acid, crotonic acid, etc., unsaturated dicarboxylic acids, such as maleic acid, fumaric acid, phthalic acid, etc. Further, available metal salts include zinc, sodium, potassium, magnesium, etc.

Available ethylene-based copolymers include, for example, resins (e.g., HI-MILAN (trademark) produced by Mitsui Polychemical Co., Ltd.) containing carboxylic metal salts as a part of an ethylene-methacrylate copolymer and generally referred to as ionomers, ethylene-acrylate copolymers (e.g., EAA (trademark) produced by Dow Chemical, Ltd.), and ethylene-based graft polymers (e.g., ADMER (trademark) produced by Mitsui Petrochemical Industries, Ltd.) having a carboxylic acid on their side chains.

This intimate resin mixture is compounded so that the ethylene-based copolymer accounts for 5 to 40 parts by weight compared to 100 parts by weight of the thermoplastic straight-chain polyester resin.

If the loading of the ethylene-based copolymer is less than 5 parts by weight, the thermal resistance of the formed insulating layers is satisfactory, but its effect of restraining the crystallization of the thermoplastic straight-chain polyester resin is reduced. Accordingly, the so-called crazing is caused by coiling such that the surface of the insulating layers suffers micro-cracking. Also, degradation of the insulating layers advances with time, thereby considerably lowering the dielectric breakdown voltage. If the loading of this copolymer exceeds 40 parts by weight, on the other hand, the thermal resistance of the insulating layers is inevitably lowered to a substantial degree. Preferably, the ethylene-based copolymer should account for 7 to 25 parts by weight compared to 100 parts by weight of the thermoplastic straight-chain polyester resin.

The material of the extrusion-coating layer b is a thermoplastic straight-chain polyester resin having the following composition.

This material is a straight-chain polyester resin which is formed by combining an acid constituent and an alcoholic constituent the whole or a part of which is cyclohexanedimethanol, an alicyclic alcohol. Specifically, polycyclohexanedimethylene terephthalate (PCT) resin may be used for this purpose. This resin has a higher thermal resistance than the aforesaid PET resin and the like.

In consideration of the requirement that the dielectric breakdown voltage should be restrained from being lowered by the degradation of the insulating layers, moreover, a modified resin should preferably be formed by blending 10 to 100 parts by weight of, e.g., a polyamide resin, polycarbonate resin, or polyurethane resin with 100 parts by weight of the thermoplastic straight-chain polyester resin.

Preferred PCT resins include, for example, EKTAR-DN, EKTAR-DA, and EKTAR-GN (trademarks; produced by Toray Industries, Inc.).

The intimate resin mixture which constitutes the extrusion-coating layer c is an intimate mixture of the aforesaid PCT resin and the ethylene-based copolymer as an essential ingredient of the intimate resin mixture used for the formation of the extrusion-coating layer a.

This intimate resin mixture is compounded so that the ethylene-based copolymer accounts for 50 parts or less by weight compared to 100 parts by weight of the PCT resin.

If the loading of this copolymer exceeds 50 parts by weight, the PCT resin cannot exhibit its high thermal resistance, so that the resulting insulating layers cannot enjoy a good thermal resistance. Preferably, the ethylene-based copolymer should account for 5 to 30 parts by weight compared to 100 parts by weight of the PCT resin.

A third insulating layer of the multilayer insulated wire according to the present invention is formed of a thermoplastic polyamide resin or an intimate resin mixture consisting mainly of this resin.

Since the third insulating layer has a relatively low coefficient of friction on its surface and a good mechanical strength, damage such as cracking of the outermost layer of the wire during the coiling operation can be minimized. Since the adhesion of this layer to the second insulating layer (polyester resin layer) is poor, moreover, damage, if any, to the outermost layer can be restrained from affecting the second insulating layer. Thus, the insulating characteristics of the whole resulting coil can be prevented from lowering.

Moreover, the third insulating layer serves to restrain lowering of the dielectric breakdown voltage with time, which is liable to be caused if the loading of the ethylene-based copolymer for the formation of the extrusion-coating layer a or c is too low, or if cyclohexanedimethanol, as the alcoholic constituent for use in the synthesis of the PCT resin for the extrusion-coating layer b or c, is too little.

Available thermoplastic polyamide resins for the formation of the third insulating layer include, for example, nylons 4, 6, 10, 11, 12, 46, 66, 610 and 612, and a copolymer of these nylons. The nylon 46 is particularly appropriate on account of its high thermal resistance.

Moreover, these polyamide resins may be incorporated with one or more of resins including, for example, ethylene-methacrylate copolymer, ethyleneacrylate copolymer, polyethylene, thermoplastic straight-chain polyester resin (mentioned before), polyurethane resin, polycarbonate resin, etc. In the resulting intimate mixture, the incorporated material or materials should account for 3 to 50 parts by weight compared to 100 parts by weight of the polyamide resin.

In the wire according to the present invention, each of the first and second insulating layers may be formed of an intimate resin mixture containing 20 parts by weight of a ethylene-based copolymer having zinc salt of a carboxylic acid at its side chain compared to 100 parts by weight of a PCT resin being condensated with cyclohexane dimethanol in the degree of 60 mol % or more, and the third insulating layer may be formed of nylon 46. In this case, the level of the thermal resistance of wire can be improved from class E (120° C.) to class B (130° C.), thus increasing usefulness.

The above-described multilayer insulated wire is manufactured in the following manner. First, a conductor is extrusion-coated with the resin or intimate resin mixture for first layer to form the first insulating layer of a desired thickness. Then, the first insulating layer is extrusion-coated with the resin or intimate resin mixture for second layer to form the second insulating layer of a desired thickness, and moreover, the second insulating layer is extrusion-coated with the polyamide resin for third layer to form the third insulating layer of a desired thickness. If necessary, an additional insulating layer is formed on the resulting structure.

The intimate resin mixtures used for the extrusion-coating with the first and second layers may be of the same composition or of different compositions which are compatible with the aforesaid permissible range of percentage composition.

Preferably, the overall thickness of the three layers thus formed is restricted to 100 μm or less. If the thickness of the second insulating layer is twice the respective thicknesses of the other insulating layers or more, the electrical properties prescribed by IEC standard No. 950. can be obtained with ease.

In forming the extrusion-coating layers which constitute the insulating layers, furthermore, if the second extrusion-coating layer is formed after water- or air-cooling the surface of the first extrusion-coating layer to 100° C. or below on finishing the extrusion-coating with the first layer, the separability between the upper and lower extrusion-coating layers can be improved.

In the case of the multilayer insulated wire described above, each of the three or more insulating layers is formed by the extrusion-coating with the intimate resin mixture, so that the productivity for its manufacture is very high. Also, the interlaminar separability between insulating layers is satisfactory, and direct soldering can be conducted during terminal processing. In the first and second insulating layers, the PET or PCT resin for use as a base resin is restrained from crystallizing, so that the electrical properties and other characteristics of the insulating layers are very unlikely to be lowered.

Since the outermost layer of the multilayer insulated wire is formed of the polyamide resin or the intimate resin mixture consisting mainly of polyamide resin, moreover, the coefficient of friction of its outer surface is so low that the layer can be restrained from being damaged during the coiling operation. Also, the degree of degradation of the first and second insulating layers can be lowered.

Meanwhile, the bondable multilayer insulated wire according to the present invention is obtained by forming a bondable layer as an extrusion-coating layer on the outermost insulating layer of the above-described multilayer insulated wire.

Available resins for the formation of the bondable layer include, for example, copolymerized-polyamide resins, such as PLATAMID M1186, M1422 and M1276 (trademarks; produced by Nihon Rilsan Co., Ltd.) and VESTAMELT X7079 (trademarks; produced by Daicel-Huls Ltd.).

In the case where the outermost insulating layer of the multilayer insulated wire is formed of the thermoplastic polyamide resin or the intimate resin mixture consisting mainly of this resin, both this resin material and the copolymerized-polyamide resin constituting the bondable layer thereon have amide bonds, respectively, so that they form strong intermolecular hydrogen bonds between each molecular, thus enjoying satisfactory adhesion properties. In other words, the bondable layer cannot be easily separated.

The bondable multilayer insulated wire can be manufactured in the following manner. First, a conductor is extrusion-coated with a resin for first layer to form a first insulating layer of a desired thickness. Then, the first insulating layer is extrusion-coated with a resin for second layer to form a second insulating layer of a desired thickness, and moreover, the second insulating layer is extrusion-coated with the polyamide resin for third layer. Thus, three insulating layers are formed. If necessary, an additional insulating layer is formed on the resulting structure, and this outermost layer is extrusion-coated with a resin for the bondable layer.

In the bondable multilayer insulated wire of the present invention, the bondable layer and the outermost insulating layer thereunder are formed individually of the same-base resins having amide bonds, so that the adhesion between these layers is high. Accordingly, the bondable layer cannot be easily separated from the outermost insulating layer during the coiling operation, and the resulting coil can hardly loosen. Thus, a high-reliability coil can be manufactured under very stable conditions.

Examples 1 to 5 and Comparative Examples 1 to 7

An intimate resin mixture was prepared for each extrusion-coating layer by kneading the constituents shown in Table 1 in the listed proportions (parts by weight).

An annealed copper wire of 0.6-mm diameter for use as a conductor was extrusion-coated with the intimate resin mixture to form a first extrusion-coating layer with the given thickness. Thereafter, a second extrusion-coating layer was formed and extrusion-coated with the intimate resin mixture, whereupon a three-layer insulating layer was completed.

In manufacturing the wire of Example 1, the surface of the resulting structure was water-cooled to 100° C. or below after each extrusion-coating process.

Each insulating layer of the wire of Comparative Example 4 was formed by winding the listed insulating tape.

TABLE 1

| | Example 1 | Example 2 | Example 3 | Example 4 | Example 5 | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|---|---|---|---|
| Composition of Intimate Resin Mixture (parts by weight) | | | | | | | | | | | | |
| First layer | | | | | | | | | | | | |
| Tetoron TR8550*1 | 100 | 100 | — | 100 | 100 | 100 | 100 | 100 | Fusion after ½-lap winding of polyester film*10 | — | — | 100 |
| FR-PMTG200A*2 | — | — | 100 | — | — | — | — | — | | — | — | — |
| HI-MILAN 1855*3 | 15 | 30 | — | — | 10 | — | 50 | 20 | | — | — | 10 |
| EAA459*4 | — | — | 7 | — | — | — | — | — | | — | — | — |
| ADMER NEO50*5 | — | — | — | 25 | — | — | — | — | | — | — | — |
| Teflon 100J*6 | — | — | — | — | — | — | — | — | | 100 | — | — |
| Amilan CM3001*7 | — | — | — | — | — | — | — | — | | — | 100 | — |
| Thickness (μm) | 15 | 25 | 20 | 20 | 20 | 20 | 20 | 20 | 25 | 20 | 20 | 20 |
| Second layer | | | | | | | | | | | | |
| Tetoron TR8550*1 | 100 | 100 | — | 100 | — | 100 | 100 | 100 | Fusion after two cycles of ½-lap winding of colored polyester film*10 | — | 100 | — |
| FR-PMTG200A*2 | — | — | 100 | — | — | — | — | — | | — | — | — |
| HI-MILAN 1855*3 | — | 20 | — | — | — | — | 60 | 20 | | — | 10 | — |
| EAA459*4 | 10 | — | 20 | — | — | — | — | — | | — | — | — |
| ADMER NEO50*5 | — | — | — | 10 | — | — | — | — | | — | — | — |
| Teflon 100J*6 | — | — | — | — | — | — | — | — | | 100 | — | — |
| Amilan CM3001*7 | — | — | — | — | — | — | — | — | | — | — | 100 |
| EKTAR-DN*8 | — | — | — | — | 100 | — | — | — | | — | — | — |
| Thickness (μm) | 50 | 40 | 40 | 50 | 40 | 40 | 40 | 40 | 50 | 30 | 40 | 40 |
| Third layer | | | | | | | | | | | | |
| Amilan CM3001*7 | 100 | 100 | 100 | — | 100 | — | 100 | — | Fusion after ½-lap winding of polyester film*10 | — | 100 | — |
| Amilan C1017*9 | — | — | — | 100 | — | — | — | — | | — | — | 100 |
| Tetoron TR8550*1 | — | — | 10 | — | — | 100 | — | 100 | | — | — | — |
| HI-MILAN 1855*3 | — | — | — | — | — | — | — | 20 | | — | — | — |
| Teflon 100J*6 | — | — | — | — | — | — | — | — | | 100 | — | — |

TABLE 1-continued

| | Example 1 | Example 2 | Example 3 | Example 4 | Example 5 | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|---|---|---|---|
| Thickness (μm) | 15 | 15 | 20 | 20 | 20 | 20 | 20 | 20 | 25 | 30 | 20 | 20 |
| Overall thickness (μm) | 80 | 80 | 80 | 90 | 80 | 80 | 80 | 80 | 100 | 80 | 80 | 80 |

*1: Trademark; polyethylene terephthalate resin from Teijin Limited.
*2: Trademark; polybutylene terephthalate from Mitsui Petrochemical Industries, Ltd.
*3: Trademark; ionomer resin from Mitsui Polychemical Co., Ltd.
*4: Trademark; ethylene-acrylate copolymer from Dow Chemical, Ltd.
*5: Trademark; ethylene-carboxylic acid graft copolymer from Mitsui Petrochemical Industries, Ltd.
*6: Trademark; polytetrafluoroethylene-polyhexafluoropropylene copolymer from Mitsui Dupont Fluorochemical Co., Ltd.
*7: Trademark; nylon 66 from Toray Industries, Inc.
*8: Trademark; copolymer type (alloy) based on terephthalic acid, cyclohexanedimethanol, and ethylene glycol from Toray Industries, Inc.
*9: Trademark; nylon 6 from Toray Industries, Inc.
*10: Film of 12- μm thickness from Teijin Limited.

Various properties of nine of these three-layer insulated wires were determined in the following manner.

Solderability:

An end portion of each wire was dipped to the depth of about 40 mm in molten solder of 400° C., and the time (sec.) required for the adhesion of the solder to the dipped 30-mm-long portion was determined. The shorter this time, the higher the solderability of the wire would be.

Electrical Insulation Properties:

The dielectric breakdown voltage was measured for each of two-and three-layer coated wires immediately after the manufacture by using a bare copper wire as one strand, according to the two-strand method based on JISC3003.

For the three-layer coated wire, its dielectric breakdown voltage was measured by the same method after it was left to stand in the atmosphere for one year, and changes of the electrical insulation properties with time were examined.

Thermal Resistance:

The three-layer coated wire and the bare copper wire were doubly twisted in accordance with JISC3003. After seven days of heating at a temperature of 200° C. in this state, the dielectric breakdown voltage was measured. The greater this value, the higher the thermal resistance would be.

Crazing Resistance:

After the wire was left to stand in the atmosphere for six months, it was wound around a coil bobbin of 12-mm diameter by means of an orientation machine, and the wire surface was checked for crazing.

Interlaminar Separability:

After each insulating layer was cut for a length of about 50 cm in the longitudinal direction by means of a cutter knife, one circumferential notch was formed on the wire so as to cover the whole circumference thereof. One end of the wire was fixed to a twisting spindle, and the other end thereof was held by means of a twisting chuck so that the wire was straight. In this state, the chuck was rotated to twist the wire in the longitudinal direction, and the rotational frequency of the chuck at which the three insulating layers were separated from one another was examined. This separation was identified when part of the insulating layers with the circumferential notch was able to be separated. The lower the rotational frequency, the higher the interlaminar separability would be.

Coilability:

The wire was regularly wound (for 50 turns) around a conductive square core having a 7-mm square cross section under a tension of 6 kg by means of a coiling machine, and a voltage of 3,000 V was applied between the wire and the square core. Then, the time required before the dielectric breakdown voltage occurred was determined. This test was conducted for each of ten coils, and the result was evaluated on the basis the average value obtained. The longer this time, the less the damage to the insulating layer during the coiling operation would be, that is, the higher the coilability would be. A guide nozzle used had a tip hole diameter 0.05 mm greater than the outside diameter of the wire, and its linear velocity was adjusted to 20 m/min.

Visual Observation after Winding:

As in the case of the coilability test, regular winding was effected to process the coil, and the wire was released from each of the ten coils obtained. The surface of the wire was observed, and the number of breaks in the insulating layer was examined.

The results of the above tests are collectively shown in Table 2.

TABLE 2

| | Properties | | | | | | | | |
|---|---|---|---|---|---|---|---|---|---|
| | Solderability (sec.) | Dielectric breakdown voltage (kV) | | Thermal resistance (kV) | Interlaminar separability (number of turns) | Coilability | | Changes of properties with time | |
| | | Second layer | Third layer | | | (sec.) | Defectives after winding (number) | Dielectric breakdown voltage after one year (kV) | Crazing |
| Example 1 | 3.5 | 11.2 | 14.2 | 11.4 | 60 | 300 or more | 0 | 13.8 | None |
| Example 2 | 3.5 | 10.8 | 13.7 | 12.2 | 90 | 300 | 0 | 13.5 | None |

TABLE 2-continued

| | Properties | | | | | | | | |
|---|---|---|---|---|---|---|---|---|---|
| | Soldera-bility (sec.) | Dielectric breakdown voltage (kV) Second layer | Dielectric breakdown voltage (kV) Third layer | Thermal resis-tance (kV) | Interlami-nar sepa-rability (number of turns) | Coilability (sec.) | Coilability Defectives after winding (number) | Changes of properties with time Dielectric break-down voltage after one year (kV) | Crazing |
| Example 3 | 3.5 | 10.6 | 13.8 | 11.8 | 90 | or more 300 | 0 | 13.2 | None |
| Example 4 | 3.5 | 11.2 | 13.3 | 12.0 | 90 | or more 300 | 0 | 12.9 | None |
| Example 5 | 3.5 | 10.4 | 13.9 | 13.1 | 90 | or more 300 | 0 | 12.8 | None |
| Comparative Example 1 | 3.5 | 9.9 | 13.5 | 11.6 | 100 or more | or more 220 | 3 | 3.9 | Noticeable |
| Comparative Example 2 | 3.5 | 10.1 | 13.1 | 2.7 | 90 | or more 300 | 0 | 12.9 | None |
| Comparative Example 3 | 3.0 | 11.2 | 13.6 | 9.2 | 100 or more | or more 84 | 8 | 12.6 | None |
| Comparative Example 4 | Not soldered | 5.7 | 7.2 | 5.9 | 60 | or more 25 | 10 | 6.8 | None |
| Comparative Example 5 | Not soldered | 10.9 | 13.6 | 11.9 | 8 | 163 | 5 | 12.4 | None |
| Comparative Example 6 | 4.0 | 7.2 | 9.5 | 7.8 | 13 | or more 200 | 4 | 7.4 | None |
| Comparative Example 7 | 4.0 | 6.5 | 8.3 | 7.3 | 45 | or more 300 | 0 | 7.9 | None |

The following are evident from Table 2.

(1) In the insulated wires of Examples 1 to 5, the first and second layers are each formed of an intimate resin mixture of an ethylene-based copolymer (hereinafter referred to as modifier) having a carboxylic acid or the like on its side chains and a thermoplastic polyester resin, and the third layer is formed of a thermoplastic polyamide resin. These wires are particularly high in solderability and good in other properties.

In the case of the insulated wire of each example described above, interlaminar separation occurred from the outer side to the inner side during the interlaminar separability test in a manner such that the third and second layers were first separated from each other, and then, the first and second layers were separated.

This indicates that the outer insulating layers are more susceptible to separation than the inner ones when external force is applied to the wire, so that the inner layers can be prevented from separating. Thus, the wires of these examples are highly reliable.

(2) The insulated wire of Example 1, in which the water-cooling process is operated as a manufacturing process following the extrusion-coating, enjoys a high interlaminar separability.

(3) The insulated wire of Comparative Example 1, in which the first and second layers are each formed only of the thermoplastic polyester resin without being loaded with the modifier, is subject to remarkable changes of properties with time, and is poor in coilability. The poor coilability is attributable to the outermost layer which is formed of the thermoplastic straight-chain polyester resin.

(4) The insulated wire of Comparative Example 2, which is formed using the intimate resin mixture loaded excessively (50 parts by weight) with the modifier, is poor in thermal resistance.

(5) In Comparative Example 3, the third insulating layer, as well as the first and second layers, is formed of the thermoplastic polyester resin loaded with the modifier. This insulated wire is poor in coilability since its third layer is not formed of the thermoplastic polyamide resin.

(6) The insulated wire of Comparative Example 4, in which the insulating layers are formed by film winding, cannot be soldered, and is low in dielectric breakdown voltage and therefore, poor in electrical insulation properties. Moreover, the outermost layer has an irregular surface, so that the coilability is poor.

(7) The insulated wire of Comparative Example 5, in which the insulating layers are each formed of a quite different resin (Teflon), cannot be soldered, either. The interlaminar separability is 8 in terms of the number of turns, indicating too poor adhesion between the layers.

(8) In the insulated wire of Comparative Example 6, in which the first and third insulating layers are each formed of the polyamide resin, is poor in coilability. Supposedly, this is because the adhesion between the insulating layers and the conductor is unsatisfactory, and the different resins are in contact between the first and second layers and between the second and third layers, so that the whole structure is very poor in adhesion.

The wire of Comparative Example 6 has a low dielectric breakdown voltage. This is probably because the two insulating layers are each formed of the polyamide resin.

(9) The wire of Comparative Example 7 in which the second and third layers are each formed of the polyamide resin, like the wire of Comparative Example 6, is poor in electrical insulation properties.

Examples 6 to 8 and Comparative Examples 8 and 9

An intimate resin mixture was prepared for each extrusion-coating layer by kneading the constituents shown in Table 3 in the listed proportions.

An annealed copper wire of 0.6-mm diameter for use as a conductor was extrusion-coated with the intimate resin mixture to form a first extrusion-coating layer with the given thickness. Thereafter, a second extrusion-coating layer was formed and extrusion-coated with the intimate resin mixture, whereupon a three-layer insulating layer was completed.

In manufacturing the wires of Examples 6 and 7, the surface of each resulting structure was water-cooled to 100° C. or below after each extrusion-coating process.

TABLE 3

| | Example 6 | Example 7 | Example 8 | Comparative Example 8 | Comparative Example 9 |
|---|---|---|---|---|---|
| Composition of Intimate Resin Mixture (parts by weight) | | | | | |
| First layer | | | | | |
| EKTAR-DA*11 | 100 | — | 100 | — | — |
| EKTAR-DN | — | 100 | — | 100 | 100 |
| Tetoron TR8550 | — | — | — | — | — |
| HI-MILAN 1855 | — | 10 | — | — | 80 |
| EAA459 | — | — | 20 | — | — |
| ADMER NEO50 | — | — | 20 | — | — |
| Teflon 100J | — | — | — | — | — |
| Thickness (μm) | 15 | 15 | 20 | 20 | 20 |
| Second layer | | | | | |
| EKTAR-DA*11 (yellow) | 100 | — | 100 | 100 | — |
| EKTAR-DN (yellow) | — | 100 | — | — | 100 |
| Tetoron TR8550 | — | — | — | — | — |
| HI-MILAN 1855 | — | 10 | 40 | — | 60 |
| EAA459 | — | — | — | — | — |
| ADMER NEO50 | — | — | — | — | — |
| Teflon 100J (yellow) | — | — | — | — | — |
| Thickness (μm) | 30 | 30 | 40 | 40 | 40 |
| Third layer | | | | | |
| Amilan CM3001 | — | — | 100 | — | 100 |
| F5001*12 | 100 | 100 | — | — | — |
| Tetoron TR8550 | — | — | — | 100 | 10 |
| Teflon 100J | — | — | — | — | — |
| Thickness (μm) | 15 | 15 | 20 | 20 | 20 |
| Overall thickness (μm) | 60 | 60 | 80 | 80 | 80 |

*11: Trademark; copolymer-type chain polyester resin (alloy type) based on terephthalic acid, cyclohexanedimethanol, and ethylene glycol from Toray Industries, Inc.
*12: Trademark; nylon 46 from Unitika Ltd.

Various properties of these three-layer insulated wires were determined in the same manner as in the cases of Examples 1 to 5. The heating temperature for the thermal resistance test was adjusted to 230° C.

The results of the above tests are shown in Table 4.

The following are evident from Table 4.

(1) The insulated wires of Examples 6 to 8, in which the first and second layers are each formed of a PCT resin, are high in any of the listed properties. Despite the heating temperature as high as 230° C. for the thermal resistance test, in particular, satisfactory test results were obtained, indicating the outstanding thermal resistance of Examples 6 to 8. In the insulated wires of Examples 6 to 8, like the wires of Examples 1 to 5, the insulating layers were successively separated from the outer side to the inner side.

TABLE 4

| | Properties | | | | | | | | |
|---|---|---|---|---|---|---|---|---|---|
| | Solderability (sec.) | Dielectric breakdown voltage (kV) | | Thermal resistance (kV) | Interlaminar separability (number of turns) | Coilability | | Changes of properties with time | |
| | | Second layer | Third layer | | | (sec.) | Defectives after winding (number) | Dielectric breakdown voltage after one year (kV) | Crazing |
| Example 6 | 5.0 | 10.2 | 12.9 | 12.0 | 60 | 300 or more | 0 | 12.0 | None |
| Example 7 | 5.0 | 9.1 | 12.5 | 11.8 | 60 | 300 or more | 0 | 13.0 | None |
| Example 8 | 4.5 | 11.2 | 14.0 | 10.1 | 90 | 300 or more | 0 | 13.3 | None |
| Comparative Example 8 | 3.5 | 10.1 | 13.1 | 10.9 | 100 | 225 or more | 3 | 2.5 | Noticeable |
| Comparative Example 9 | 4.5 | 9.9 | 14.0 | 5.8 | 90 | 300 or more | 0 | 12.6 | None |

(2) The insulated wire of Example 6, in which the first and second layers are each formed only of the PCT resin, exhibits good properties. With use of the PCT resin, the changes of properties with time are negligible (see Comparative Example 1) without the loading of the modifier. In order to obtain these satisfactory properties, however, it is believed that the third layer should be formed of a thermoplastic polyamide resin (see Comparative Example 8).

(3) The insulated wires of Examples 6 and 7, in which the cooling process is operated following the extrusion-coating, enjoys a high interlaminar separability.

(4) The insulated wire of Comparative Example 8, in which the outermost layer is formed of the PET resin, is subject to remarkable changes of properties with time. This is probably because degradation of the PCT resin is liable to advance due to the use of the PET resin, not the polyamide resin, for the outermost layer. Further, this wire is poor in coilability.

(5) The insulated wire of Comparative Example 9, which is loaded excessively with the modifier, is poor in thermal resistance.

Examples 9 to 11 and Comparative Examples 10 to 12

An intimate resin mixture was prepared for each extrusion-coating layer by kneading the constituents shown in Table 5 in the listed proportions (parts by weight).

An annealed copper wire of 0.6-mm diameter for use as a conductor was extrusion-coated with the intimate resin mixture to form a first extrusion-coating layer with the given thickness. Thereafter, a second extrusion-coating layer was formed and extrusion-coated with the intimate resin mixture, and finally, the resulting structure was extrusion-coated with a resin for a bondable layer, whereupon a bondable three-layer insulating layer was completed.

TABLE 5

| | Example 9 | Example 10 | Example 11 | Comparative Example 10 | Comparative Example 11 | Comparative Example 12 |
|---|---|---|---|---|---|---|
| Composition of Insulating Layers (parts of weight) | | | | | | |
| First layer | | | | | | |
| Tetoron TR8550 | 100 | 100 | 100 | 100 | 100 | — |
| HI-MILAN 1855 | 20 | 10 | 10 | 10 | 10 | — |
| Teflon 100J | — | — | — | — | — | 100 |
| Thickness (μm) | 25 | 25 | 25 | 25 | 25 | 25 |
| Second layer | | | | | | |
| E-390NAT*13 | 10 | 100 (yellow) | 10 | 30 | 20 | — |
| Tetoron TR8550 | 100 (yellow) | — | 100 (yellow) | 100 (yellow) | 100 (yellow) | — |
| Teflon 100J | — | — | — | — | — | 100 (yellow) |
| Thickness (μm) | 25 | 25 | 25 | 25 | 25 | 25 |
| Third layer | | | | | | |
| Tetoron TR8550 | 20 | 10 | — | 100 | 100 | — |
| HI-MILAN 1855 | — | — | — | 10 | 10 | — |
| Amilan 3001N*14 | 100 | 100 | 100 | — | — | — |
| Teflon 100J | — | — | — | — | — | 100 |
| Thickness (μm) | 25 | 25 | 25 | 25 | 25 | 25 |
| Overall thickness (μm) | 75 | 75 | 75 | 75 | 75 | 75 |
| Composition of Bondable Intimate Resin Mixture (parts of weight) | | | | | | |
| PLATAMID M1276*15 | 100 | — | — | — | — | — |
| PLATAMID M1422*16 | — | 100 | — | — | — | — |
| VESTAMELT X7079*17 | — | — | 100 | — | 100 | 100 |
| VESTAMELT 4580*18 | — | — | — | 100 | — | — |
| Thickness (μm) | 20 | 20 | 20 | 20 | 20 | 20 |

*13: Trademark; thermoplastic polyurethane resin from Nippon Miractran Co., Ltd,
*14: Trademark; nylon 66 from Toray Industries, Inc.
*15: Trademark; copolymerized-polyamide from Nihon Rilsan Co., Ltd.
*16: Trademark; copolymerized-polyamide from Nihon Rilsan Co., Ltd.
*17: Trademark; copolymerized-polyamide from Daicel-Huls Ltd.
*18: Trademark; copolymerized-polyester from Daicel-Huls Ltd.

Various properties of these six bondable three-layer insulated wires were determined in the following manner.

Solderability:

This property was examined under the same conditions for the cases of Examples 1 to 5.

Thermal Resistance:

This property was examined under the same conditions for the cases of Examples 1 to 5.

Bonding Strength:

Each wire was formed into a helical coil of 5-mm diameter. The wires of Examples 9 to 11 and Comparative Examples 10 to 12 were heated at 160° C. for 15 minutes, while the wire of Example 10 was heated at 140° C. for 15 minutes. Thereafter, these wires were measured for bonding strength at normal temperature and at 80° C. in accordance with JIS3003.

Adhesion of Bondable Layer (Coiling Tests):

The entire coating was cut in the longitudinal direction by means of the cutter knife to be extended by 3% as each wire was coiled around the coil bobbin of 12-mm diameter. Then, it was observed whether or not the bondable layer and the insulating layers were separated from one another. In general, this test is conducted to determine whether or not separation is caused between the bondable layer and the insulating layers during normal coiling operation. In this case, no separation should be caused.

Coilability:

The wire was regularly wound (for 50 turns) around a conductive square core having a 7-mm square cross section under a tension of 6 kg by means of a coiling machine, and a voltage of 3,000 V was applied between the wire and the square core. Then, the time required before the dielectric breakdown voltage occurred was determined. This test was conducted for each of ten coils, and the result was evaluated on the basis the average value obtained. The longer this time, the less the damage to the insulating layer during the coiling operation would be, that is, the higher the coilability would be. A guide nozzle used had a tip hole diameter 0.05 mm greater than the outside diameter of the wire, and its linear velocity was adjusted to 10 m/min.

Interlaminar Separability:

This property was examined under the same conditions for the cases of Examples 1 to 5.

The results of the above tests are collectively shown in Table 6.

Comparative Example 11 is an example in which the polyester resin is used for the third insulating layer, and a different copolymerized-polyamide resin is used for the formation of the bondable layer. In this case, the bondable layer is separated during the coiling operation, and the bonding strength is low.

Comparative Example 12 is an example in which a Teflon resin is used for each insulating layer, and the different copolymerized-polyamide resin is used for the formation of the bondable layer. Probably due to poor adhesion between the individual layers, in this case, the results of coiling tests are poor, and the bondable layer is separated, indicating the absence of the bonding strength. Furthermore, no solderability is exhibited at all.

What is claimed is:

1. A multilayer insulated wire comprising:

(i) a conductor; and (ii) three or more insulating layers covering the conductor, each of first and second insulating layers, as counted from the conductor side, being selected from the group consisting of (a) an extrusion-coating layer of an intimate resin mixture compounded so that an ethylene-based copolymer, having a carboxylic acid or a metal salt of the carboxylic acid on a side chain thereof, accounts for 5 to 40 parts by weight to 100 parts by weight of a thermoplastic straight-chain polyester resin formed by combining an aliphatic alcoholic constituent and an acid constituent, (b) an extrusion-coating layer comprising a thermoplastic straight-chain polyester resin, the whole or a part of which is formed by combining a cycloaliphatic alcoholic constituent and an acid constituent, and (c) an extrusion-coating layer of an intimate resin mixture compounded so that an ethylene-based copolymer, having a carboxylic acid or a metal salt of the carboxylic acid on the side chain thereof, accounts for 50 parts or less by weight to 100 parts by weight of a thermoplastic straight-chain polyester resin, the whole or a part of the thermoplastic straight-chain polyester resin is formed by combin-

TABLE 6

| Properties | | Example 9 | Example 10 | Example 11 | Comparative Example 10 | Comparative Example 11 | Comparative Example 12 |
|---|---|---|---|---|---|---|---|
| Solderability (sec.) | | 3.5 | 3.5 | 3.5 | 4.0 | 3.5 | Not soldered after 20 sec. |
| Thermal resistance (kV) | | 11.1 | 10.9 | 11.2 | 11.4 | 10.8 | 12.3 |
| Bonding strength (g) | Normal temperature | 430 | 460 | 390 | 290 | 95 | ***0 |
| | 80° C. | 300 | 280 | 220 | 178 | 75 | ***0 |
| Coiling test | | Not separated | Not separated | Not separated | Not separated | Partially separated | Separated |
| Interlaminar separability of insulating layers | | Easily separated | Easily separated | Easily separated | Easily separated | Easily separated | Easily separated |
| Coilability | (sec.) | 300 or more | 300 or more | 300 or more | 300 or more | 300 or more | 216 or more |
| | Defectives after winding (number) | 0 | 0 | 0 | 0 | * | ** |

*Five bondable layers were separated.

**Two insulating layers were torn and all bondable layers were separated. One wire snapped during coiling operation.

***The bondable layer was separated during manufacture of a helical coil.

Examples 9 to 11 are examples in which a polyamide resin is used for the third layer, and an copolymerized-polyamide resin is used for the formation of the bondable layer. As seen from Table 6, these examples are high in any of the listed properties.

Comparative Example 10 is an example in which a polyester resin is used for the third insulating layer, and a copolymerized-polyester resin is used for the the formation of the bondable layer. Although this example is high in any of the listed properties, it is lower in bonding strength than Examples 9 to 11.

ing a cycloaliphatic alcoholic constituent and an acid constituent, and a third insulating layer being an extrusion coating layer of a thermoplastic polyamide resin or an intimate resin mixture comprising of the thermoplastic polyamide resin.

2. A multilayer insulated wire according to claim 1, wherein each of said first and second insulating layers is the extrusion-coating layer (a).

3. A multilayer insulated wire according to claim 1, wherein each of said first and second insulating layers is the extrusion-coating layer (b) or (c).

4. A multilayer insulated wire according to claim 1, wherein the thickness of said second insulating layer is twice or more the thickness of a thicker one of the first and third insulating layers.

5. A multilayer insulated wire according to claim 1, wherein said third insulating layer is formed of nylon 46.

6. A multilayer insulated wire according to claim 1, wherein said insulating layers are separated from one another, the insulated wire is straight and a longitudinal notch and a circumferential notch are in each of said insulating layers.

7. A multilayer insulated wire according to claim 6, wherein a plurality of said insulated wire are twisted by at least 20 turns.

8. A multilayer insulated wire according to claim 1, wherein said cycloaliphatic alcoholic constituent is cyclohexanedimethanol.

9. A multilayer insulated wire according to claim 1, wherein the ethylene-based copolymer is selected from the group consisting of an ionomer resin, an ethylene-acrylate copolymer and an ethylene-carboxylic acid graft copolymer; the thermoplastic straight-chain polyester resin for the extrusion-coating layer (a) is selected from the group consisting of polyethylene terephthalate resin, polybutylene terephthalate resin and polyethylene naphthalate resin; the thermoplastic straight-chain polyester resin for the extrusion-coating layer (b) and for the extrusion-coating layer (c) is a copolymer based on terephthalic acid, cyclohexanadimethanol and ethylene glycol; and the thermoplastic polyamide resin is selected from the group consisting of nylon 4, nylon 6, nylon 10, nylon 11, nylon 12, nylon 46, nylon 66, nylon 610 and nylon 612.

10. A bondable multilayer insulated wire comprising:

(i) a conductor;

(ii) three or more insulating layers covering the surface of the conductor; and (iii) a bondable layer covering the outermost one of the insulating layers, each of first and second insulating layers, as counted from the conductor side, being selected from the group consisting of (a) an extrusion-coating layer of an intimate resin mixture compounded so that an ethylene-based copolymer, having a carboxylic acid or a metal salt of the carboxylic acid on a side chain thereof, accounts for 5 to 40 parts by weight to 100 parts by weight of a thermoplastic straight-chain polyester resin formed by combining an aliphatic alcoholic constituent and an acid constituent, (b) an extrusion-coating layer comprising a thermoplastic straight-chain polyester resin, the whole or a part of which is formed by combining a cycloaliphatic alcoholic constituent and an acid constituent, and (c) an extrusion-coating layer of an intimate resin mixture compounded so that an ethylene-based copolymer, having a carboxylic acid or a metal salt of the carboxylic acid on the side chain thereof, accounts for 50 parts or less by weight to 100 parts by weight of a thermoplastic straight-chain polyester resin, the whole or a part of the thermoplastic straight chain polyester resin is formed by combining a cycloaliphatic alcoholic constituent and an acid constituent, a third insulating layer being an extrusion-coating layer of a thermoplastic polyamide resin or an intimate resin mixture comprising the thermoplastic polyamide resin, and the bondable layer being an extrusion-coating layer of an copolymerized-polyamide resin.

11. A multilayer insulated wire according to claim 10, wherein each of said first and second insulating layers is the extrusion-coating layer (a).

12. A multilayer insulated wire according to claim 10, wherein each of said first and second insulating layers is the extrusion-coating layer (b) or (c).

13. A multilayer insulated wire according to claim 10, wherein the thickness of said second insulating layer is twice or more the thickness of a thicker one of the first and third insulating layers.

14. A multilayer insulated wire according to claim 10, wherein said third insulating layer is formed of nylon 46.

15. A multilayer insulated wire according to claim 10, wherein said insulating layers are separated from one another, the insulated wire is straight and a longitudinal notch and a circumferential notch are in each of said insulating layers.

16. A bondable multilayer insulated wire according to claim 10, wherein said cycloaliphatic alcoholic constituent is cyclohexanedimethanol.

17. The multilayer insulated wire according to claim 10, wherein the ethylene-based copolymer is selected from the group consisting of an ionomer resin, an ethylene-acrylate copolymer and an ethylene-carboxylic acid graft copolymer; the thermoplastic straight-chain polyester resin for the extrusion-coating layer (a) is selected from the group consisting of polyethylene terephthalate resin, polybutylene terephthalate resin and polyethylene naphthalate resin; the thermoplastic straight-chain polyester resin for the extrusion-coating layer (b) and for the extrusion coating layer (c) is a copolymer based on terephthalic acid, cyclohexanedimethanol and ethylene glycol; and the thermoplastic polyamide resin is selected from the group consisting of nylon 4, nylon 6, nylon 10, nylon 11, nylon 12, nylon 46, nylon 66, nylon 610 and nylon 612.

18. In a transformer including a wire element, wherein the improvement comprises the wire element being multilayer insulated wire comprising;

(i) a conductor; and (ii) three or more insulating layers covering the conductor, each of first and second insulating layers, is counted from the conductor side, being selected from the group consisting of (a) an extrusion-coating layer of an intimate resin mixture compounded so that an ethylene-based copolymer, having a carboxylic acid or a metal salt of the carboxylic acid on a side chain thereof, accounts for 5 to 40 parts by weight to 100 parts by weight of a thermoplastic straight-chain polyester resin formed by combining an aliphatic alcoholic constituent and an acid constituent, (b) an extrusion-coating layer comprising a thermoplastic straight-chain polyester resin, the whole or a part of which is formed by combining a cycloaliphatic alcoholic constituent and an acid constituent, and (c) an extrusion-coating layer of an intimate resin mixture compounded so that an ethylene-based copolymer, having a carboxylic acid or a metal salt of the carboxylic acid on the side chain thereof, accounts for 50 parts or less by weight to 100 parts by weight of thermoplastic straight-chain polyester resin, the whole or a part of the thermoplastic straight-chain polyester resin is formed by combining a cycloaliphatic alcoholic constituent and an acid constituent, and a third insulating layer being an extrusion coating layer of a thermoplastic polyamide resin or an intimate resin mixture comprising of the thermoplastic polyamide resin.

19. In a transformer including a wire element, wherein the improvement comprises the wire element being the bondable multilayer insulated wire comprising (i) a conductor;

(ii) three or more insulating layers covering the surface of the conductor; and (iii) a bondable layer covering the outermost one of the insulating layers, each of first and second insulating layers, as counted from the conductor side, being selected from the group consisting of (a) an extrusion-coating layer of an intimate resin mixture compounded so that an ethylene-based copolymer, having a carboxylic acid or a metal salt of the carboxylic acid on a side chain thereof, accounts for 5 to 40 parts by weight to 100 parts by weight of a thermoplastic straight-chain polyester resin formed by combining an aliphatic alcoholic constituent and an acid constituent, (b) an extrusion-coating layer comprising a thermoplastic straight-chain polyester resin, the whole or part of which is formed by combining a cycloaliphatic alcoholic constituent and an acid constituent, and (c) an extrusion-coating layer of an intimate resin mixture compounded so that an ethylene-based copolymer, having a carboxylic acid or a metal salt of the carboxylic acid on the side chain thereof, accounts for 50 parts or less by weight to 100 parts by weight of the thermoplastic straight-chain polyester resin, the whole or a part of the thermoplastic straight-chain polyester resin is formed by combining a cycloaliphatic alcoholic constituent and an acid constituent, a third insulating layer being an extrusion-coating layer of a thermoplastic polyamide resin or an intimate resin mixture comprising the thermoplastic polyamide resin, and the bondable layer being an extrusion-coating layer of an copolymerized-polyamide resin.

* * * * *